United States Patent [19]

Arai

[11] Patent Number: 4,698,856

[45] Date of Patent: Oct. 13, 1987

[54] VENTILATED HELMET

[76] Inventor: Michio Arai, 12, Azuma-cho 2-chome, Ohmiya-shi, Saitama-ken, Japan

[21] Appl. No.: 910,412

[22] Filed: Sep. 22, 1986

[51] Int. Cl.[4] ..... A42B 3/00

[52] U.S. Cl. ..... 2/425; 2/171.3

[58] Field of Search ..... 2/171.3, 425

[56] References Cited

U.S. PATENT DOCUMENTS

| | | | |
|---|---|---|---|
| 3,925,821 | 12/1975 | Lewicki | 2/425 |
| 4,075,714 | 2/1978 | Ryder et al. | 2/425 X |
| 4,081,865 | 4/1978 | Bergee et al. | 2/425 |
| 4,115,874 | 9/1978 | Hasegawa | 2/425 |
| 4,519,099 | 5/1985 | Kamiya et al. | 2/171.3 X |
| 4,612,675 | 9/1986 | Broersma | 2/425 X |
| 4,622,700 | 11/1986 | Sundahl | 2/425 |

*Primary Examiner*—Louis K. Rimrodt

*Attorney, Agent, or Firm*—Popper, Bobis & Jackson

[57] ABSTRACT

This invention provides a helmet provided with a ventilation arrangement wherein a duct defining an air intake opening is mounted on a window edge of the forehead of a helmet body, and within the helmet body a guide groove in communication with a blowing opening of the duct is formed by cutting a side cushion mounted internally of a shock absorbing liner and an air outflow groove is defined by cutting a part of the side cushion positioned on the side of the back of the head.

3 Claims, 6 Drawing Figures

VENTILATED HELMET

BACKGROUND OF THE INVENTION

1. Field of the Invention

This invention relates to a helmet, and more specifically to a helmet to be worn when riding on a motor cycle and an automobile.

2. Prior Art

Generally, the helmets to be worn when driving a motor-cycle or an automobile are of a full-face type, a jet type, etc. However, it is often, during the wearing of these helmets, that a shield is applied to the opening of the front surface of the helmet to protect the eyes from air blowing thereagainst.

Therefore, sometimes, air does not sufficiently come into the helmet so that the head on which the helmet is worn becomes hot and stuffy and the brow gets perspired and feels an unpleasantness.

In order to overcome such an inconvenience as noted above, it has been proposed to form a hole(s) for introducing air in communication with the interior of the helmet body at the forehead of and in the vicinity of the edge where air strikes the front of the helmet body. However, the provision of the hole in such a place deteriorates the strength of the helmet itself, possibly producing an effect on the safety. Furthermore, there has been proposed a full-face type helmet in which in consideration of the strength, an intake construction is provided on a guard portion of the jaws below a window hole bored in the front surface so as to guide and blow the introduced air toward the upper part within the helmet. However, in any of the aforementioned intake constructions, when air is blown through a cushion material provided internally of the helmet, an air flow is impaired by the cushion material failing to expect good ventilation.

SUMMARY OF THE INVENTION

It is an object of the present invention to provide a helmet provided with a ventilation arrangement which is simple in construction and able to introduce air therein without producing no influence on the strength in the front part of the helmet which is the most suitable part in introducing air and the most important part in absorbing the shock.

It is a further object of the invention to provide a helmet which provides a ventilation while air introduced into the helmet is directly striking against the head body without impairing the flow of air by the presence of the cushion material.

The above objects and features of the present invention will be more completely understood from reading the ensuing detailed description in connection with the accompanying drawings. The drawings are merely provided for interpretation and not intended to limit the scope of the invention.

BRIEF DESCRIPTION OF THE DRAWINGS

The drawings show one embodiment of the present invention.

DETAILED DESCRIPTION OF THE INVENTION

Figure 1:
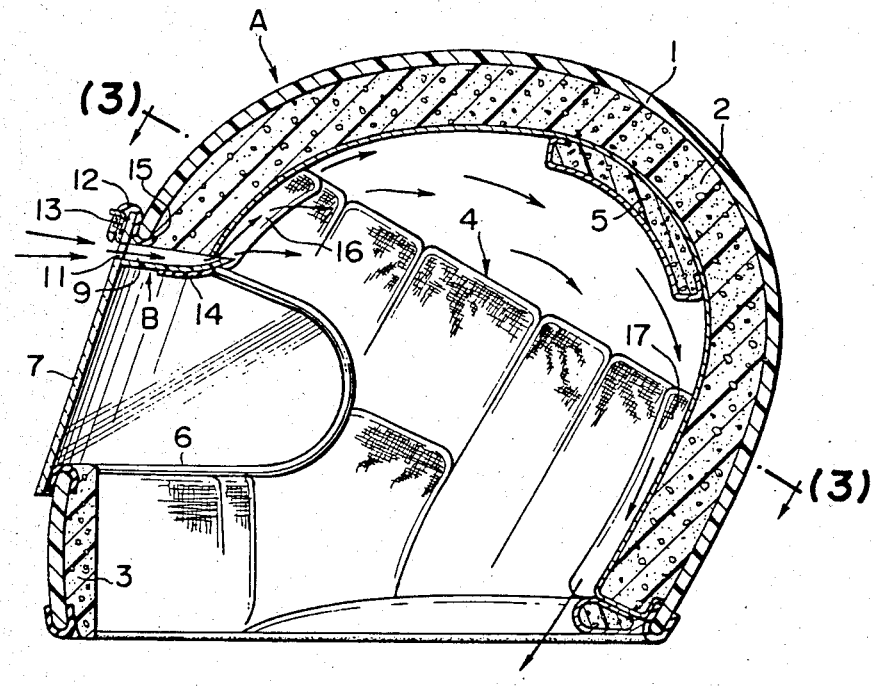
FIG. 1 is a longitudinal sectional side view.
Figure 2:
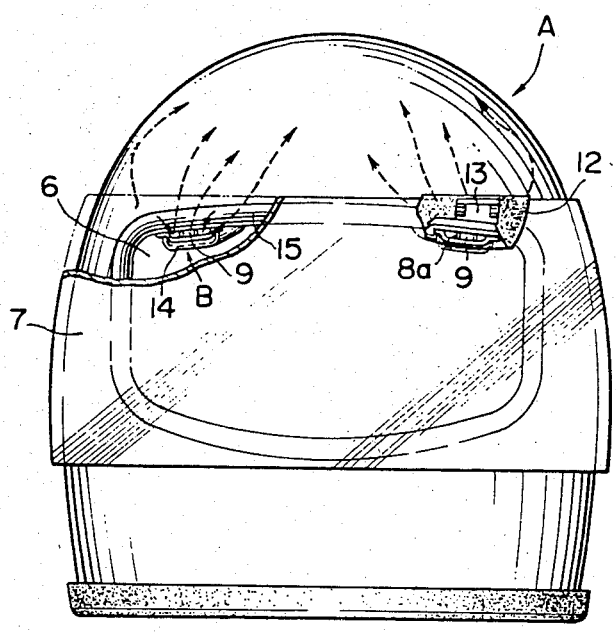
FIG. 2 is a front view partly in section.
Figure 3:
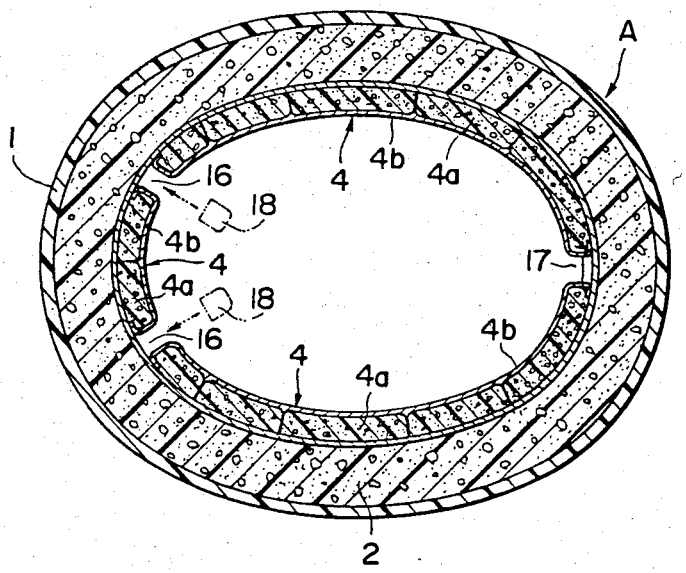
FIG. 3 is a sectional view taken on line 3—3 of FIG. 1.
Figure 4:
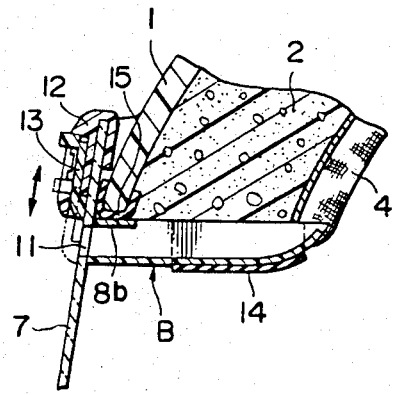
FIG. 4 is an enlarged sectional view of an air intake portion.
Figure 5:
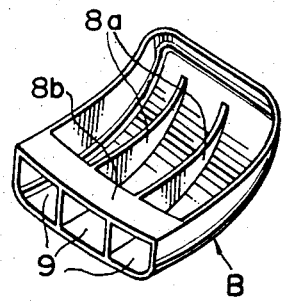
FIG. 5 is a perspective view of a duct mounted on the helmet body.

One embodiment of the present invention will be described by way of a full-face type helmet with reference to the drawings. Reference character A designates a helmet body, and B designates a duct.

The helmet body A is composed of a cap body 1 molded from a material such as FRP, a shock absorbing liner 2, which is formed of a polystyrene form of a material having a shock absorbing performance which is equal to or more than that of the polystyrene, fitted internally of the cap body 1, a jaw guard 3 formed of polystyrene foam or the like extending from the jaws to the left and right temple portions within the cap body 1, a side cushion 4 mounted on the inner surface of the shock absorbing liner 2, a head cushion 5, and a chin strap not shown.

In the cap body 1 of the helmet body A is formed a window hole 6 in a rectangular shape on the whole so that eye portions are exposed to the front surface thereof, the window hole 6 being opened and closed by a transparent shield 7 rotatably mounted externally of the cap body 1.

The side cushion 4 provided internally of the shock absorbing liner 2 is made in such a manner that a cushion material **4*a* having a good permeability, for example, a coarse net-like polyurethane foam, is wrapped by an inside cloth 4*b* which is agreeable to the touch and has a good permeability. A flat duct B is held in position by adhesive and keep band 14 on both left and right sides of an upper hole edge of a window hole 6 in the helmet body A. The inside cloth 4*b*** in direct touch with the head body is formed of a special water absorbing cloth which carries all the sweat to the rear of the cloth so as to always feel refreshed.

The duct B is formed of a soft plastic or a rubber so that if the helmet should receive a shock, the duct B would be deformed so as not to damage the head. The duct B is formed of the aforementioned material into a flat rectangular shape whose front and upper surfaces are open, the depth thereof having a dimension which is the length from the front end edge of the window hole 6 to the side cushion 4. The duct B includes therein two flat-plate like partition and ribs **8*a* stood upright from the front end toward the rear end, an air intake 9 defined at the front end by a lateral web 8*b* for connecting the partition and ribs 8*a* to each other, and the rear portion of the lower surface is curved circularly toward the upper end so that the inflow air may flow toward the upper surface of the rear portion, namely, the inner surface of the shock absorbing liner 2**.

In mounting the duct B, the duct B is inserted adjacent a keep band 14 secured to the lower surface of the upper hole edge of the window hole 6 with the upper opening thereof joined to the lower surface of the front end of the liner 2, and a lateral web **8*b* on the front side of the upper surface is bonded by the adhesives to a rubber-made edge 15 secured to the edge of the window hole of the cap body 1 whereby the duct B is fixed in position. Thereby, the upper surface from the front to the rear portion of the duct B is closed by the shock absorbing liner 2, and only the upper surface of the rear portion is projected inwardly of the liner 2. Then, the duct B is in the form which is fitted into the guide groove 18 formed by cutting the side cushion 4**.

Accordingly, air entered from the air intake 9 of the duct B flows from the opening of the upper surface of the rear portion into the guide groove 16 formed by cutting the side cushion 4, and the air to the top within the helmet body A is blown to cool the head.

The air blown into the helmet passes through an air outflow groove 17 formed by longitudinally cutting a rear part of the side cushion mounted within the helmet body A and is discharged outside from the lower side at the rear portion of the helmet. This means that the air within the helmet is drawn out by the negative pressure at the rear of the neck projecting downwardly from the helmet body A and the flow of air within the helmet body A.

The shield 7 for opening and closing the window hole 6 of the helmet body A is bored with a hole 11 in communication with the air inlet 9 of the duct B.

It is noted that the hole 11 in the shield 7 may be in the same shape as that of the air intake 9 but it will be of course noted that the flow rate may be adjustable by the provision of a means for opening and closing the hole 11 as shown. The means for opening and closing the hole 11 is constructed such that a plastic mounting frame 12 and a slide plate 13 are mounted on the side of the shield 7 so that the slide plate 13 is moved upward and downwad to thereby adjust the opening degree of the hole 11 to adjust the quantity of air flowing into the duct B.

In a winter season or the like which requires no ventilation, the slide 13 is operated to close the hole 11, and the guide groove 16 within the helmet body A is filled up by fitting in position an auxiliary side cushion 18 formed in the same shape as that of said guide groove.

It is to be noted that the mounting of the duct B is not limited to both left and right sides of the open hole edge of the forehead but any place suitably selected among the center or other places.

Figure 6:
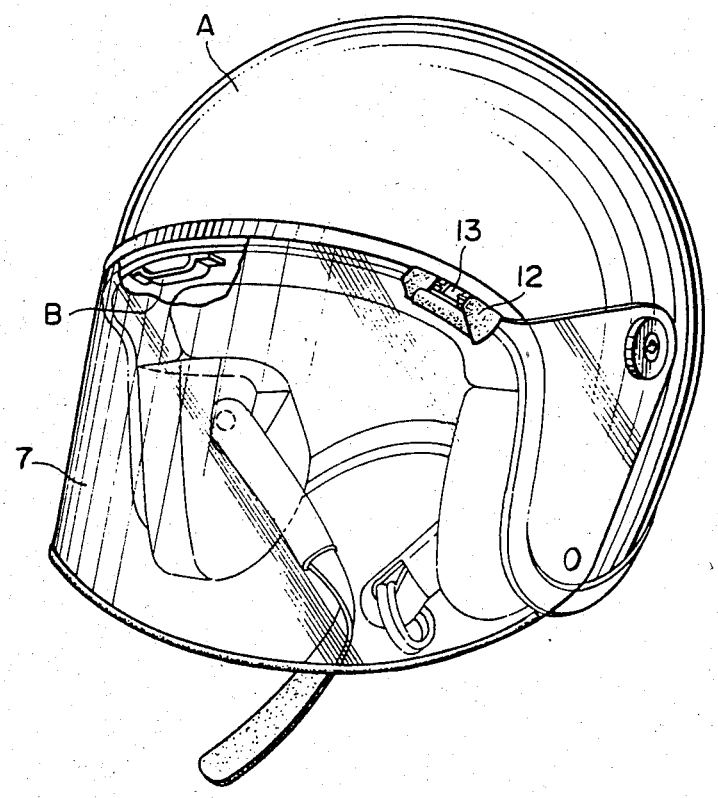
FIG. 6 is a perspective view showing a jet type helmet.

While in the foregoing, the helmet of the full-face type has been described, it is noted that in the case of the jet type helmet, a duct is mounted on the lower edge of the forehead portion as shown in FIG. 6 so as not to impair the view required for travelling. It is also noted that the mounting of the duct B and the formation of the guide groove and air outflow groove within the helmet is similar to that of the full-face type.

EFFECTS OF THE INVENTION

According to the helmet of the present invention, as described above, an air intake is defined at an open hole edge of a forehead in a helmet body, a duct having a length extending to the inside of a shock absorbing liner is mounted, a guide groove in communication with a blowing opening of the duct is formed within the helmet body by cutting a side cushion provided internally of a shock absorbing liner, and an air outflow groove is formed by cutting a part of a side cushion positioned on the side of the back of the head. Therefore, the air discharged from the air intake of the duct flows toward the top of the head through the guide groove and is blown into the helmet to effectively cool the head.

Moreover, the duct is mounted without any work such as making a hole in the helmet itself or the like, and therefore there involves no fear that the strength of the helmet is deteriorated. Furthermore, since the duct is formed of a pliable material, there is no danger resulting therefrom, and in addition, the mounting position of the duct is at the open hole edge of the forehead, and therefore, there is no danger to impair the view required for travelling of the vehicle.

I claim:

1. A helmet comprising:

a helmet body positionable about the head of a user;

said helmet body having an inner surface and a face opening at a front portion of said helmet body;

a shock absorbing liner mounted to the inner surface of said helmet body, said shock absorbing liner having an inner surface;

a side cushion mounted to the inner surface of the shock absorbing liner, said side cushion being cut to define a guide groove at a front portion of said side cushion and being cut to define an air outflow groove at a back portion of said side cushion;

an air intake defined at an upper end of said opening in opposing relation to the forehead of the user;

a shield mounted to a front portion of said helmet body in covering relation to said air intake, said shield having a hole in an upper part thereof which is in fluid communication with said air intake and which does not affect the user's view when riding on a vehicle; and a duct mounted to said helmet body at the upper end of said opening at said air intake, said duct having a length extending to the inner surface of said shock absorbing liner, and a blowing opening extending through said duct and fluidly connecting said hole in said shield with said guide groove.

2. A helmet according to claim 1, wherein said duct is mounted to said helmet body at left and right upper ends of said opening.

3. A helmet according to claim 1; further comprising adjustable air blocking means for adjustably blocking air permitted to enter through the hole in said shield.

* * * * *